United States Patent [19]

Gillen, Jr.

[11] 4,239,419

[45] Dec. 16, 1980

[54] PRECAST CONCRETE THREADED PILINGS

[76] Inventor: William F. Gillen, Jr., 6518 Lamb Rd., New Orleans, La. 70126

[21] Appl. No.: 844,962

[22] Filed: Oct. 27, 1977

Related U.S. Application Data

[63] Continuation-in-part of Ser. No. 738,124, Nov. 2, 1976, abandoned, and a continuation-in-part of Ser. No. 670,978, Mar. 26, 1976, abandoned.

[51] Int. Cl.[2] ..... E02D 5/56

[52] U.S. Cl. ..... 405/232; 52/157; 405/252; 405/253; 405/256

[58] Field of Search ..... 61/53, 53.5, 56, 56.5, 61/53.74; 405/251, 252, 253, 254, 256, 232; 52/157

[56] References Cited

U.S. PATENT DOCUMENTS

| | | | |
|---|---|---|---|
| 1,041,035 | 10/1912 | Cummings | 61/56 |
| 1,563,024 | 11/1925 | Grimaud | 405/254 |
| 1,809,574 | 6/1931 | Straub | 61/56 |
| 1,848,339 | 3/1932 | Geiger | 405/251 |
| 2,011,459 | 8/1935 | Snow et al. | 405/253 |
| 2,343,350 | 3/1944 | Warren | 52/157 X |
| 2,673,453 | 3/1954 | Templeton | 61/53.74 |
| 3,545,214 | 12/1970 | Grazel | 61/56 |
| 3,889,482 | 6/1975 | Frederick | 61/53.74 X |

FOREIGN PATENT DOCUMENTS

| | | | |
|---|---|---|---|
| 1156711 | 3/1954 | Fed. Rep. of Germany | 61/53.5 |
| 60056 | 5/1912 | Switzerland | 61/56 |

OTHER PUBLICATIONS

Russian Publication, Journal "Power Construction Abroad", No. 1, 1970, pp. 37, 38; Application Screw Piles in France.

*Primary Examiner*—David H. Corbin
*Attorney, Agent, or Firm*—C. Emmett Pugh & Associates

[57] ABSTRACT

A reinforced concrete threaded pile provides a generally conically shaped tapered concrete pile member which is provided with a metallic reinforcement core for carrying the torsional and tensile forces created in the pile during its insertion. A metallic head is provided at, for example, the upper portion of the pile, which provides a point for the connection of a sufficient torsional driving force thereto for insertion of the pile. The head member can be metallic, and is substantially integrally connected to the reinforcement core, so that the torsional forces can be developed through the head and the reinforcement core such that torsional and tensile forces are not carried by the concrete to a degree which would cause a failure of the concrete by cracking. The concrete body is provided with an outer surface of spiral threads which has a relatively minor thread pitch that provides for relatively easy insertion of the pile into the desired soil medium and is mechanically compatible therewith. If desired, reinforcement can be provided in the threads. The threads are equally spaced, and a female "soil socket" is formed upon insertion of the pile into the earth, the spiral tapered pile gradually expanding and compacting the surrounding soil as the equally spaced threads push the pile downward.

32 Claims, 15 Drawing Figures

Fig. 3
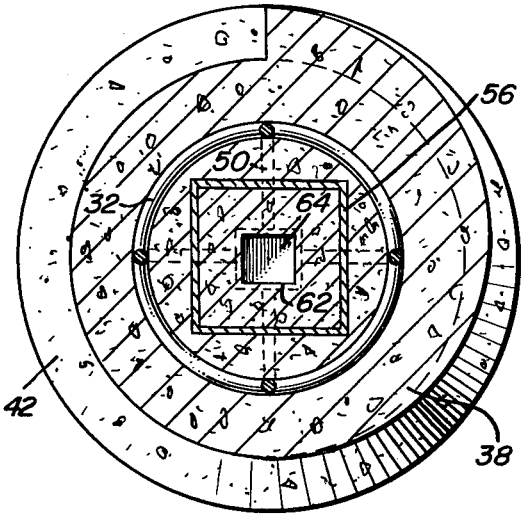
Fig. 4
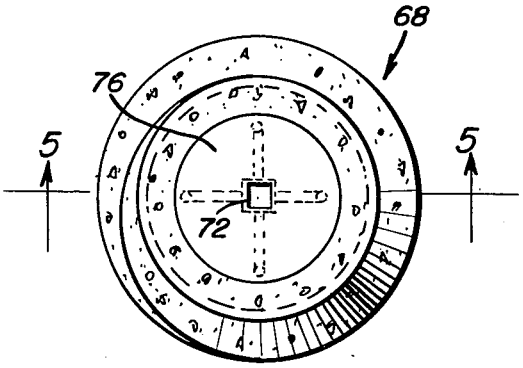
Fig. 6
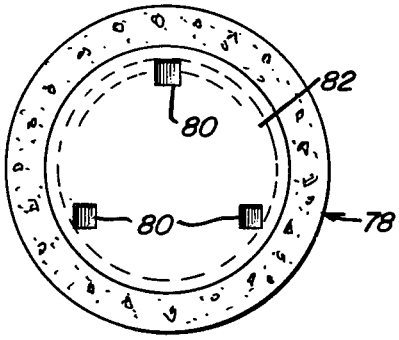
Fig. 5
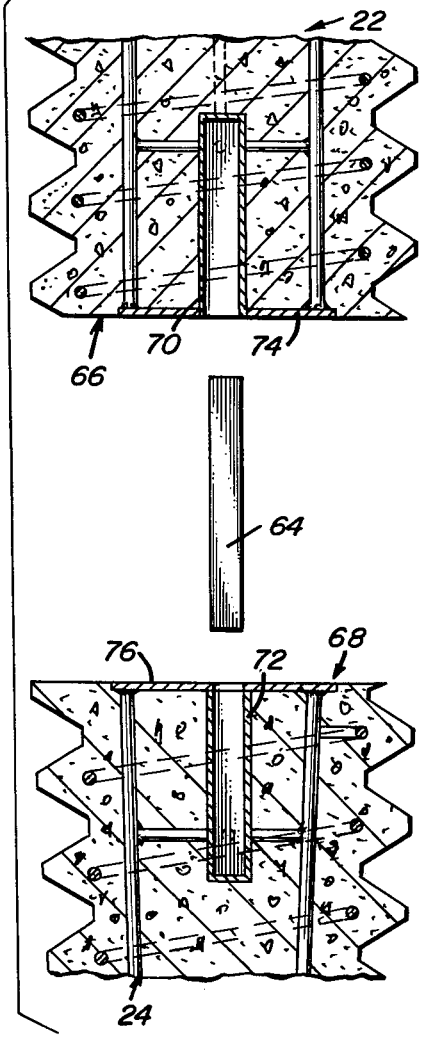
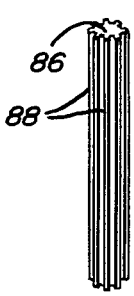
Fig. 7

PRECAST CONCRETE THREADED PILINGS

CROSS REFERENCE TO A RELATED APPLICATION

This application is a continuous-in-part of the two copending parent applications Ser. No. 670,978 filed Mar. 26, 1976 and Ser. No. 738,124 filed Nov. 2, 1976 both abandoned in favor of this application.

BACKGROUND OF THE INVENTION

1. Field of the Invention

This invention relates generally to piles, and particularly to precast reinforced concrete screw-threaded piles. This invention further relates to concrete piling constructed in sections to permit variations in the length of the piles.

2. Description of the Prior Art

In areas such as New Orleans, La. and adjacent parishes, or in soft and marshy lands which exist in places other than La., it is necessary to employ piles to provide a proper foundation for buildings and similar structures. Most commonly employed for residential and light commercial construction are friction piles usually constructed of wood. These piles may run 20 to 25 feet in length and must be driven into the ground by special machinery of large size. Accordingly, where such machinery is inaccessible, property owners have been unable to undertake desired construction.

A problem encountered with the use of precast concrete screw-threaded piling is encountered during handling of the piling between the manufacturing facility and site where the piling is to be used. Further, the length requirements for the piling varies as a function of the depth required at a particular site. Thus, it has generally been necessary in the past to construct such precast piling in a great variety of lengths in order to provide piling only of the length necessary for a particular application.

Another problem encountered with precast concrete screw-threaded piling is attainment of adequate strength at the threaded peripheral portions of the piles. This problem becomes more acute the deeper and closer together are the threads of the piles. While U.S. Pat. No. 1,563,024, issued Nov. 24, 1925, to G. Grimaud, discloses a reinforced concrete stake which employs shallow, widely spaced screw-threads formed on the outer surface of a concrete body and reinforced by a spiral binding wire wrapped around a framework extending parallel to the core of the stake, this construction is limited as to the depth of threads which may be employed due to the necessity of keeping the framework on which the binding wire is wound spaced a predetermined minimum distance from the bottom surfaces of the threads.

It is particularly desirable in order to construct a precast concrete screw-threaded piling which can be efficiently threaded into the earth, and the like, even by the use of an installer's hands, to have the screw-threads of the piles as deep and as close together as possible. The problem arises, however, of providing suitable reinforcement for such deep and closely spaced screw-threading.

A further problem experienced in prior art devices, is that the tensile and torsional stresses developed during the insertion of a concrete pile into the earth cannot be carried by concrete. It is known in the art, that concrete has great compressive strength, but has little or no tensile strength and little or no torsional strength. Thus, it has been a problem with prior art devices that the piling were not properly reinforced from the point of attachment of a suitable torsional driving force throughout the pile. Thus, the piling of the prior art would not be suitable for driving, because torsional stress would cause the concrete portion of the pile to fail. The following is a table of some prior art devices which have been patented.

PRIOR ART PATENTS

| PATENT NO. | INVENTOR(S) | ISSUE DATE |
|---|---|---|
| U.S. 712,839 | McGowan | November 4, 1902 |
| U.S. 3,151,464 | Sato, et al | October 6, 1964 |
| U.S. 996,688 | Vernon-Inkpen | July 4, 1911 |
| U.S. 2,011,457 | Snow, et al | August 13, 1935 |
| Netherlands 44171 | Eirhard | 1938 |
| Netherlands 88487 | Ludowici | 1958 |
| U.S. 1,563,024 | Grimaud | November 24, 1925 |
| U.S. 3,757,528 | Finsterwalder, et al | September 11, 1973 |
| U.S. 1,203,543 | Haymaker, et al | October 31, 1916 |
| U.S. 1,041,035 | Cummings | October 15, 1912 |
| U.S. 2,343,350 | Warren | March 7, 1944 |
| German 1,156,711 | Ludowici | 1963 |

Each of these above-referenced devices has shortcomings which make them unsuitable or ineffective. The present invention solves the below listed prior art problems and short comings in a simple and inexpensive manner.

Accordingly, below is a discussion of the known prior art piling devices with a brief discussion of problems each fails to solve.

The McGowan patent (U.S. Pat. No. 712,839) reference shows a typical telephone underground conduit. A square rod is shown which, it is belived only takes shear, but no torsion. The device is provided because of differential ground settlement experienced by such conduits.

The Sato patent shows a joint which is arranged to take pure shear rather than torsion. The connector 21 is solid steel and does not extend to the reinforcing in the pile. The joint is not properly attached to the pile, since no reinforcements, welded or otherwise are provided. Note that the rod reinforcing shown is not adequate further since no horizontal ties are shown. The socket of Sato is simply an unreinforced pocket and will not take torsion or any shear or bending forces without cracking.

The Vernon-Inkpen device shows a pile in which closely spaced threads are provided. However, the taper is very high causing high torsional forces during installation. Further, the threads are not shown but for a small initial length of the pile causing tension at the thread-to-shaft transition. Cracks would definitely result as the threads were inserted into soil where piles are needed. There is no head shown for the application of torsional force to the pile, or the integral connection of the reinforcing core of the pile to this head for rotation. The reinforcing shown is a mesh or expanded metal, and not a welded core as is shown in the patent application of the present invention.

The Snow device (U.S. Pat. No. 2,011,459) is an "impact pile". This pile has no torsional capability, since the connection is made with grout.

The Eirhard reference (Netherlands Pat. No. 44171) shows no reinforcing means between the male square tube and the upper pile section. An extreme pitch is shown with a very high taper. The threaded point of the pile is driven by the steel hexagonal outer shell. The inner concrete portion is merely in "in-fill" added afterwards and does not take any of the torsion which is generated when the pile is inserted.

Netherlands Pat. No. 88487 to Ludowici shows a steel pile, not a concrete one. The pile is hollow and is rotated by means of an insertable inner means. No reinforcement is taught, and no integral connection between a head arranged for rotating the pile and the reinforcement core is shown.

The Grimaud pile (U.S. Pat. No. 1,563,024) shows a very steep pitch. Such a pitch would cause the shaft to shear in soil because the torsional force would be so great due to the great vertical travel required per revolution. In many cases, the soil threads would "strip" causing no vertical penetration. Likewise, this device shows threads which stop after the first few feet. The reinforcing cage is not integrally connected with the head to which a rotational force is connected for driving the pile.

A steel screw auger is first used to make a hold in the Finsterwalder patent (U.S. Pat. No. 3,757,528). Then the hole is armored with a steel pipe, which may then be drawn out and the hole is thereafter filled with concrete. This is a cast-in-place type concrete structure rather than a threaded pile which is inserted by rotational force.

U.S. Pat. No. 1,203,543 to Haymaker provides a metal cage without any concrete and is totally different than the structure as taught by the present invention. No concrete whatsoever is shown nor is there shown a head arranged for rotation which is integrally connected with the reinforcement core. This structure is not in fact a pile at all and will not take torsion.

The Cummings device (U.S. Pat. No. 1,041,035) is not a screw-threaded pile at all and has no relation to the present invention which provides a screw-threaded pile for insertion by rotational energy. This is an impact-type pile, and it will tear the soil as it goes down. It is driven with a steel mandril either from inside or out.

U.S. Pat. No. 2,343,350 to Warren provides a completely steel pile rather than a concrete pile provided with steel reinforcement. It has no application to a concrete shaft as is taught by the present invention. Further, it is noted that the threads shown are only provided for a short distance at the very tip portion of the pile, rather than being provided along the entire piling length.

A spiral pile to Ludowici is shown in German Pat. No. 1,156,711, but no reinforcement or any concrete is shown. The pile does not have any reinforcement and thus, cannot teach the use of a reinforcement core integrally connected with a metallized head which is arranged to receive rotational energy. In further comment, the pitch provided on the pile is too steep to make it practical.

GENERAL DISCUSSION OF THE PRESENT INVENTION

It is an object of the present invention to provide a screw-threaded pile which is easier to insert and affords more effective frictional gripping surface than prior screw-threaded pile.

It is another object of the present invention to provide a pile which can be installed by hand where suitable machinery is unavailable or inaccessible.

It is yet another object of the present invention to provide a pile which avoids problems of erosion of the pile by electrolysis and similar electrochemical and chemical reactions.

It is another object of the present invention to provide an extendible pile system wich permits piling to be constructed in sections for transport to a field site and for assembly in a length appropriate to the geophysical conditions encountered at the site.

It is another object of the present invention to provide an efficient and simple, yet rugged and reliable, connecting arrangement for attaching together sections of a precast concrete screw-theaded pile.

These and other objects are achieved according to the present invention by providing a pile having: a preferably metallic head arranged for being rotated by suitable machinepowered or manual driving tools; a metallic reinforcement core connected to the head for rotation by the head, and having a longitudinal axis extending from the head to a tip, about which axis the core is rotated by the head; and a body in the form of a solid mass of concrete disposed embedding the core and rotating therewith, the body tapering from the head to the tip of the core and having an outer surface providing equal'y spaced threads along the entire length between the head and the tip with the screw theads facilitating insertion of the pile in earth by rotation of the head. Torsional and tensile stresses are transmitted from the metallic head to the integrally connected reinforcement core, with the tensile and torsional stresses developed throughout the pile, thereby preventing failure of the concrete.

The body advantageously is constructed from a cementitious material such as concrete cast about the core, while the core itself is preferably from ferrous reinforcing bar, as commonly known and conventionally used, for reinforcing the cementitious material.

According to one preferred embodiment of the invention, the core is a framework of longitudinally extending reinforcing bars and longitudinally spaced collars, with the bars tied to the collars and the diameter of the collars decreasing from the head of the pile to the tip of the core so that the core tapers from the portion thereof either adjacent to or forming a portion of the head down to the tip of the core.

An alternative embodiment of a core according to the invention provides a single longitudinally extending reinforcing bar having tied thereto at least one, and preferably several, crossbars extending transversely of the longitudinal extent of the single bar.

The upper head portion may be constructed in any one of several preferred ways, among which are the use of a solid, preferably metallic cast head, the use of a metal sleeve affixed directly to the reinforcing bars of the core, and the extension of the reinforcing bars to form a framework about which a metallic or cementitious head may be formed. Advantageously, but not necessarily, the head is in the form of a hexagon, similar to a conventional nut, in order to facilitate engagement of the head by a conventional driving tool. Alternatively, or in addition, one or more bores or holes may be provided in the head transversely of the longitudinal extent of the core for receiving a driving rod which can be used to facilitate rotation of the head of the pile.

It is desireable that the upper portion of the pile provide a point of attachment for a suitable torsional driving force capable of threadably driving the pile into the desired soil. A metallic upper portion having integral attachment with the reinforcing core is preferred, however, a metallic head can be achieved by providing greater surface area to the point of application of the torsional force and heavily reinforcing this area adjacent the application of the torsional driving force.

These and other objects according to the present invention are achieved by providing additionally an extendible pile system having: a pair of pile sections; and a connector arrangement associated with the pile sections for releasably attaching the pile sections together for rotation with one another. The connector arrangement preferably includes opposed sockets provided in adjacent ones of the sections to be connected together, and a key removably arranged in the sockets for locking the sections against relative rotational movement about their longitudinal axes.

The connector arrangement can also include a plurality of opposed sockets provided in the sections to be connected together, with these sockets having associated therewith a like number of keys. By this arrangement, the amount of torque which can be exerted on the pile is greatly increased.

According to one preferred embodiment of an extendible pile system according to the present invention, one of the sections of the pile is provided with a projection and the other of the sections with a recess having a bottom and arranged for receiving the projection. The socket of one of the sections is disposed in the projection, while the socket of the other of the sections is disposed in the bottom of the recess which receives the projection. Steel plates, and the like, line the bottom of the recess and cover the top surface of the projection of the other of the sections, which surface abuts the bottom of the recess when the two sections are placed together, so as to permit the pile to be driven into the earth as well as to be screwed thereinto by rotation.

The core of each section of a pile, according to the invention, advantageously includes a central frame extending along the longitudinal axis of the core, and has a spiral reinforcing element pitched to the pitch of the screw-threads of the section and disposed winding around the frame in spaced relation thereto. This reinforcing element permits deeper and more closely spaced threads to be used so as to increase the efficiency of the resulting pile to that where the pile can be screwed into the earth even by manual rotation where desired.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 3 is a sectional view taken generally along the line 3—3 of FIG. 2.

FIG. 4 is a top plan view showing the bottom section of a pile constructed according to a second embodiment of the present invention.

FIG. 5 is an enlarged, fragmentary, sectional view taken generally along the line 5—5 of FIG. 4.

FIG. 6 is a top plan view showing a bottom section of a third embodiment of a pile according to the present invention.

FIG. 7 is a perspective view showing a modified connector key for use with any of the embodiments of add-on pile section, according to the invention.

DESCRIPTION OF THE PREFERRED EMBODIMENTS

FIGS. 1–7 show various exemplary embodiments of a multi-section pile system including an initial pile with one or more "add-on" section; while FIGS. 8–12 show various exemplary embodiments of a single pile which is similar in structure to the initial or lowermost section of the pile systems of FIGS. 1–7. Accordingly, for a beginning understanding of the subject matter of the present invention, the embodiments of FIGS. 8–12 will be described first.

Figure 8:
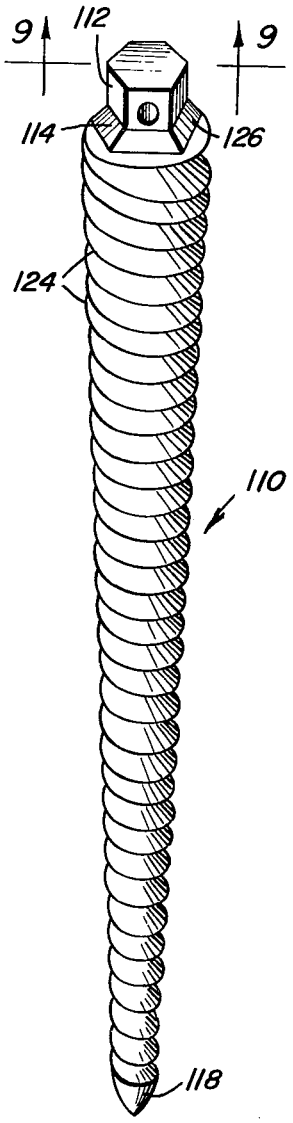
FIG. 8 is a perspective view showing the general configuration of a pile according to the present invention, with one preferred embodiment of a head for the pile.
Figure 9:
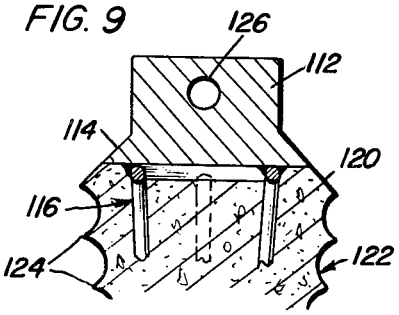
FIG. 9 is a fragmentary, enlarged, sectional view taken generally along the line 9—9 of FIG. 8.

Referring now to FIGS. 8 and 9 of the drawings, a screw-threaded pile 110 includes a head 112 constructed from a piece of solid material, such as a suitable steel, and having a substantially hexagonal shape for receiving a conventional driving socket tool (not shown), or the like, in order to rotate the head 112 when pile 110 is being installed. The lower portion of head 112 terminates in a flared skirt 114 which comes down over the main portion of the pile 110 so as to form a transition. A core 116 is connected to head 112 in a suitable manner for rotation by head 112, and has a longitudinal axis extending from the head 112 to a tip 118 of pile 110, about which axis core 116 is rotated by the head 112.

A body 120 in the form of a solid mass constructed from a cementitious material cast about the core 116 is disposed embedding the core 116 and rotates with the core 116 during installation of pile 110. In other words, head 112, core 116, and body 120 form an integral unit. Body 120 has an outer surface 122 which tapers continuously along the entire length of core 116 from head 112 to tip 118, and is provided with spiral screw threads 124 along the entire length of body 120 for facilitating insertion of pile 110 in earth (not shown) by rotation of head 112.

Threads 124 will preferably be supplied at a minimum thread pitch, or a minimum number of threads per foot which would be sufficient to give mechanical advantage that would allow piling 110 to be inserted easily into any desired soil medium. The insertion of the pile into the soil should be achieved with minimal torsional stresses generated, so as not to cause the pile or adjacent soil to fail. (The mechanics of insertion of the pile into the soil will be discussed more fully hereinafter, and particularly with reference to FIG. 13, 14, and 15). This in combination with the appropriate reinforcing cage 136 and the appropriate attachment of the reinforcing cage 136 to the head which is provided for application of a torsional force will achieve the desired result.

Head 112 is provided with a transverse through bore 126 arranged for receiving a driving, or leverage, bar (not shown) to impart rotational torque to head 112 in order to cause rotation of pile 110 as it is being installed.

Figure 10:
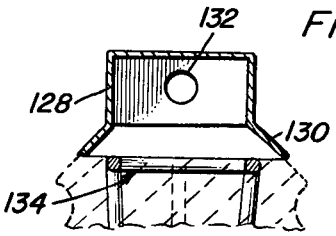
FIG. 10 is a fragmentary, sectional view, similar to FIG. 9, but showing a modified embodiment of a head for a pile according to the invention.

Referring now to FIG. 10 of the drawing, a head is shown similar in configuration to head 112, but constructed as a, for example, steel sleeve 128 ending in a depending flared skirt 130 and provided with a transverse bore 132 similar to bore 126 for receiving a leverage rod. Sleeve 128, possibly at the skirt 130 thereof, is fastened to the reinforcing bars of a core 134 in a conventional manner, such as by welding, prior to the casting of a body about the core 134. It will be appreciated that core 116 of pile 110 will also be appropriately attached to head 112, such as by welding, prior to the casting of body 120 about the core 116. Since such attaching and casting techniques are well known in the particular arts, these techniques will not be described in detail herein. The connection between core 116 and head 112 will be an integral connection so that the torsional stresses generated in head 112 when a suitable driving force is attached thereto will be developed through core 116 into the entire pile 110. It should be understood, that it is desireabe to develope the tensile and torsional forces generated during insertion through the reinforcement members of core 136. Thus, head 130 is preferably metal and integrally connected to core 136 by welding or the like. However, a substantially similar effect could be achieved by providing a heavily reinforced socket or head having a lrge concrete area to which a suitable torsional force is attached. In the latter structure, although the surface would be in fact concrete, the head, if heavily reinforced (the reinforcement attached to core 136), would perform as satisfactorily as metallic head 112 and the term "metallic head" or upper portion is intended to include such equivalent structures.

Figure 11:
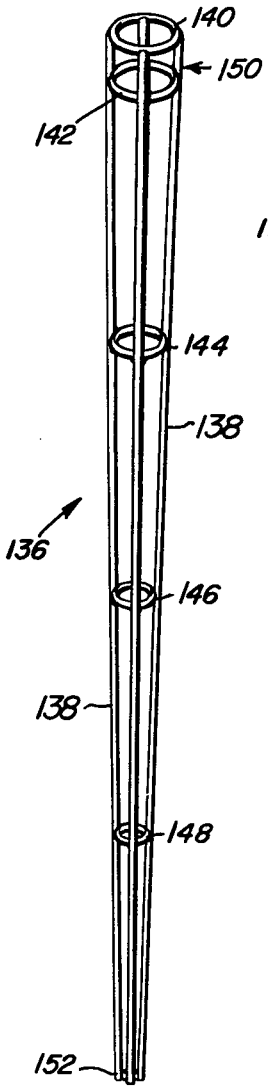
FIG. 11 is a perspective view showing one embodiment of a core for a pile according to the present invention.

FIG. 11 of the drawings shows one preferred construction of a core for a pile according to the invention, wherein the core is a framework 136 of longitudinally extending reinforcing bars 138 and longitudinally spaced collars 140, 142, 144, 146, and 148. The bars are tied to the aforementioned collars in the conventional manner, with the diameter of the collars beginning with collar 142 decreasing from the head area 150 toward the tip 152 of the core so as to create a continuously tapering, or linear slope, to the core. While collar 140 is illustrated as being of substantially the same diameter as collar 142, it is possible to construct collar 140 of slightly smaller diameter than collar 142 so as to use the portion of framework 136 between collars 140 and 142 as a cage for defining a head associated with the core. For example, the portion of framework 136 which extends between collars 140 and 142 may be inserted into the sleeve 128 (FIG. 10) in a manner not shown, or the portion of framework 136 between the collars 140 and 142 may be surrounded by a straight steel sleeve welded to the reinforcing bars and cast into an outer head portion as in the embodiment shown in FIG. 12 of the drawing.

Figure 12:
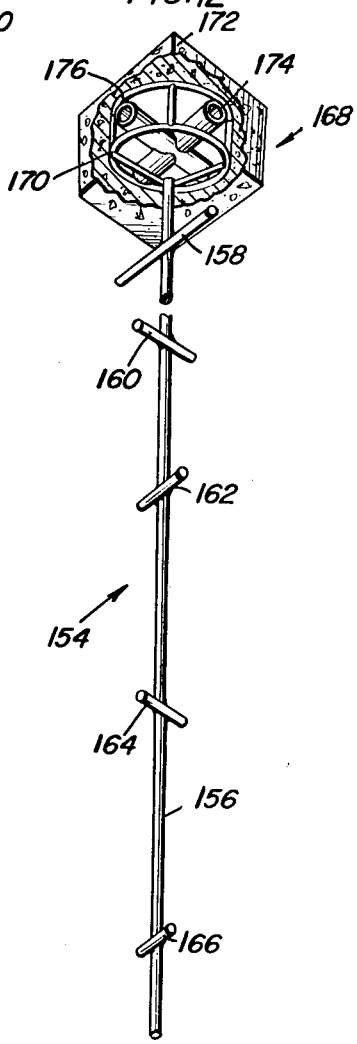
FIG. 12 is a perspective view, partly cut away and in section, showing yet another embodiment of a pile according to the present invention.

Referring now more particularly to FIG. 12 of the drawing, a core 154 is shown which includes a single longitudinally extending reinforcing bar 156 having tied thereto at least one, and preferably the illustrated plurality of cross-bars 158, 160, 162, 164 and 166 such that the aforementioned cross-bars extend transversely of the longitudinal extent of bar 156.

Core 154 is illustrated in FIG. 12 as being affixed to a head 168 constructed as a framework forming a generally cylinderical open cage 170 embedded in a mass 172 of a cementitious or other suitable casting material. Provided within this mass 172, and disposed extending transversely to the longitudinal extent of bar 156, is at least one hole disposed for receiving a leverage bar (not shown). In FIG. 12 a pair of such cross-holes or bores are illustrated as formed by a pair of intersecting tubes 174 and 176 extending completely through the mass 172 which embeds cage 170. These tubes 174 and 176 may be attached to the reinforcing bars forming cage 170 in a suitable manner, such as by welding or by the use of tie-wire, with the use of the pair of intersecting holes as formed by tubes 174 and 176 permitting an installer to make quarter turns, as for an installation of a pile next to a building or other object where a 360° turn is impossible.

Figure 1:
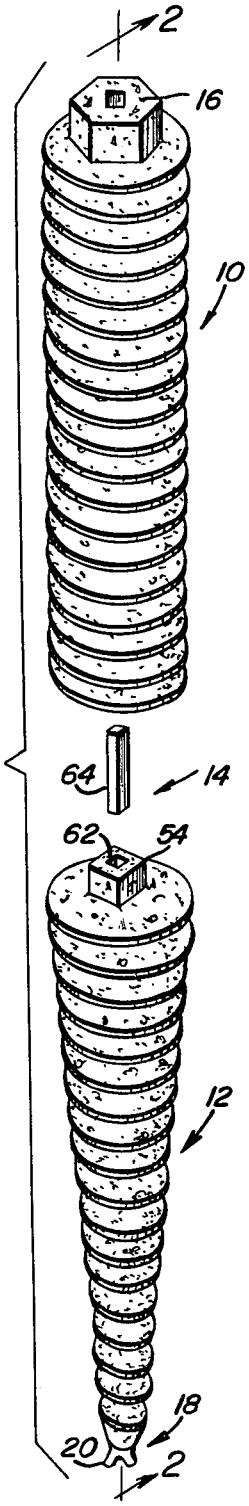
FIG. 1 is an exploded, perspective view showing a first embodiment of a pile formed by add-on sections according to the present invention.
Figure 2:
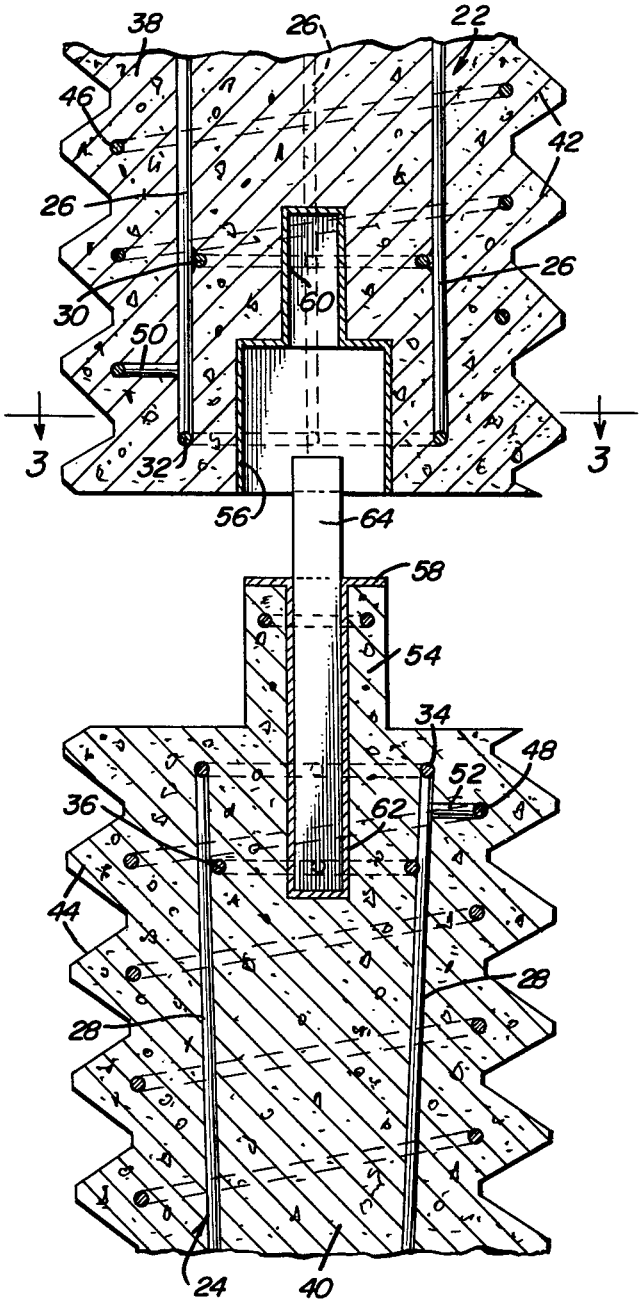
FIG. 2 is an enlarged, fragmentary, sectional view taken generally along the line 2—2 of FIG. 1, with the connecting key displaced from the position shown in FIG. 1.

Referring now more particularly to FIGS. 1 through 3 of the drawings, a first embodiment of an extendible pile according to the present invention is shown as including a head section 10 and a tip section 12 attached together for rotation with one another by a connector arrangement 14. While only a pair of sections 10 and 12 have been shown, it will be appreciated that middle sections (not shown), in any number desired, similar to section 10, but without the head 16, can be inserted between sections 10 and 12 to make the length of the resulting pile that desired for a particular application. In addition, the bottom or tip section 12 can be employed itself as a pile, if desired, by attaching a suitable turning handle or device, neither of which is shown, to the key receiving socket in the uppermost portion of section 12 as is to be described below.

In addition to head 16, the pile formed by sections and 12 also includes a tip 18 disposed at the lower portion of the tapered tip section 12. Note FIG. 13, where an enlarged partial view of a preferred tip 18 is provided. This tip 18 may take the form of the illustrated cutter 20, if desired, although a conventional point (FIG. 13) may also be used. Each of the sections 10 and 12 also includes a frame 22, 24, respectively, formed of longitudinally extending reinforcing bars 26, 28, and longitudinally spaced collars 30, 32, and 34, 36. It will be appreciated that other collars similar to those shown will be spaced out along the longitudinal extent of the sections 10 and 12. The bars 26 and 28 are tied to the aforementioned collars 30, 32, and 34, 36, as well as the other collars not shown, in the conventional manner of attaching such reinforcing elements, with the diameter, of the collars in the tapered section 12 decreasing from the portion of section 12 adjacent section 10 toward the tip 18 of section 12 so as to create a continuous tapering or linear slope, to the core formed by frame 24. Each of the sections 10 and 12 also includes a respective body 38, 40 in the form of a solid mass constructed from a cementitious material cast about the associated frame 22, 24. Each respective body 38, 40 embeds the core formed by the associated frame 22, 24 and rotates with the core during installation of the pile. In other words, the frame 22, 24 and body 38, 40 of the sections 10, 12, cooperate to form an integral unit. Each body 38, 40 also has an outer surface provided with screw-threads 42, 44 along the entire length of each section 10, 12. These threads 42, 44 facilitate insertion of the pile in earth (not shown) by rotation of head 16.

Head 16 may be connected to the frame 12 of section 10 in a manner as shown in FIGS. 9 and 10, the connection being sufficient to develop torsional stresses from head 116 to frame 22.

In addition to the central frame 22 extending along the longitudinal axis of the core of the associated sections 10, 12, each of the sections 10, 12 further includes a spiral reinforcing element 46, 48 having a pitch similar to the pitch of the associated screw-threads 42, 44 and disposed winding around the respective frames 22, 24 in spaced relationship therewith. Tie bars 50, 52 connect the elements 46, 48 to the frame 22, 24 such that the entire set of reinforcing elements are connected together, but the spacing of the element 46, 48 from the associated frame 22, 24 permits the element 46, 48 to be disposed at the base of, or even within, the associated thread 42, 46 for reinforcing the thread 42, 44 even when the same is very deep in configuration.

While the number of threads 42, 44 per foot of axial length of sections 10, 12 can vary in accordance with particular conditions expected to be encountered, in general the number of threads for a class 9 residential piling with an 8" butt and a 5" tip should be at least 6 to the foot, with $1\frac{3}{4}$" depth per thread, along the longitudinal extent of the cores of the sections 10, 12 in order to achieve the desired efficiency of insertion of the resulting pile into the ground which is to anchor the pile.

Section 12 is provided with a projection 54, while section 10 is provided with a recess 56 having a bottom surface and arranged for receiving the projection 54. As can be readily seen from FIG. 2, projection 54 is capped with a steel plate 58, and the like, while the recess 56, including the bottom surface thereof, is entirely defined by cooperating steel plates such that the bottom surface of the recess 56 and the top of projection 54 will be steel plated in order to permit the pile to be driven into the ground as opposed to being screwed therein. A socket 60, which may also be formed from a steel casing, and the like, is provided extending inwardly of section 10 along the axial extent thereof from the bottom surface of recess 56, while a mating socket 62 is provided in projection 56, so as to communicate with an opening suitably provided in the plate 58. In the sockets 60 and 62 is inserted a connecting key 64 which cooperates with the projection 54 in mating recess 56 to cause the sections 10 and 12 to resist torque and rotate to one another even when the sections are being rotated into the ground. It will be appreciated that suitable reinforcing members connect the recess 56, and its associated socket 60, as well as the socket 62 to the remainder of the integral reinforcing element network of the respective sections 10 and 12.

It should be appreciated that the welding or like attachment of reinforcement members 30, 32 to recess 56 and the similar connection of reinforcement members 34, 36, to socket 62 provides integral connections which will develope the torsional stresses created at the joint into the reinforcing steel and throughout the pile. Thus, no failure of the concrete will result at the connection because of the application of torsional or tensile stresses applied directly to the concrete.

Note in FIG. 2 that threads 42, 44 "feather" at the end portions of sections 38, 40 near the joint. With such a "feathering" structure, a continuous, even pitch thread 42, 44 will be maintained.

Referring now more particularly to FIGS. 4 and 5 of the drawings, sections 66 and 68 are illustrated which are similar to sections 10 and 12, except that the projection 54 and recess 56 are omitted. Rather, these sections 66 and 68 are provided with respective socket 70 and 72 fashioned and arranged in a manner similar to the sockets 60 and 62 and having associated therewith plates 74 and 76 across the abutting surfaces of the sections 66 and 68. These plates 74 and 76 serve a similar purpose as the bottom surface of recess 56 and the plate 58 of the sections 10 and 12. Otherwise, sections 16 and 68 are constructed in essentially the same manner as sections 10 and 12.

It should be understood that the reinforcement shown in FIG. 5 is integrally connected to the socket 70 by welding or the like so that torsional stress is applied to socket 70 through the connection will be transmitted to the reinforcing frame provided in the pile. In each of the embodiments of the connections shown, the corresponding recesses and projections are provided with steel plates which transmit torsional stresses directly to reinforcement which is in each case integrally welded to or a similar connection formed with the reinforcing steel. Thus, a development of torsional stresses is seen through the steel, that is the steel in the connection and the reinforceing steel in the concrete. No torsional or tensile stresses needs be carried by the concrete.

FIG. 6 shows another embodiment of the present invention wherein the connector arrangement includes a plurality of sets of sockets and keys. More specifically, a section 78 is illustrated which is provided with three sockets 80 equally spaced on a substantially planar end face 82 of the section. This face 82 may constitute a plate similar to plates 74 and 76, while it will be understood that a key, such as key 64, may be inserted in each of the sockets 80 and into some cooperating sockets which will be opposed to the sockets 80 in a section (not illustrated) having an end surface essentially the same as face 82 of section 78.

The cross-sectional shape of the key employed with a connector arrangement according to the invention can assume different shapes from the square section of key 64, such as the round section of key 84 which may be formed from a rod 86 provided with a plurality of longitudinally, or axially extending splines 88. It will be appreciated that the sockets associated with key 84 must be suitably configured in order to receive the splines 88.

PILE OPERATION - SOIL MECHANICS

Figure 15:
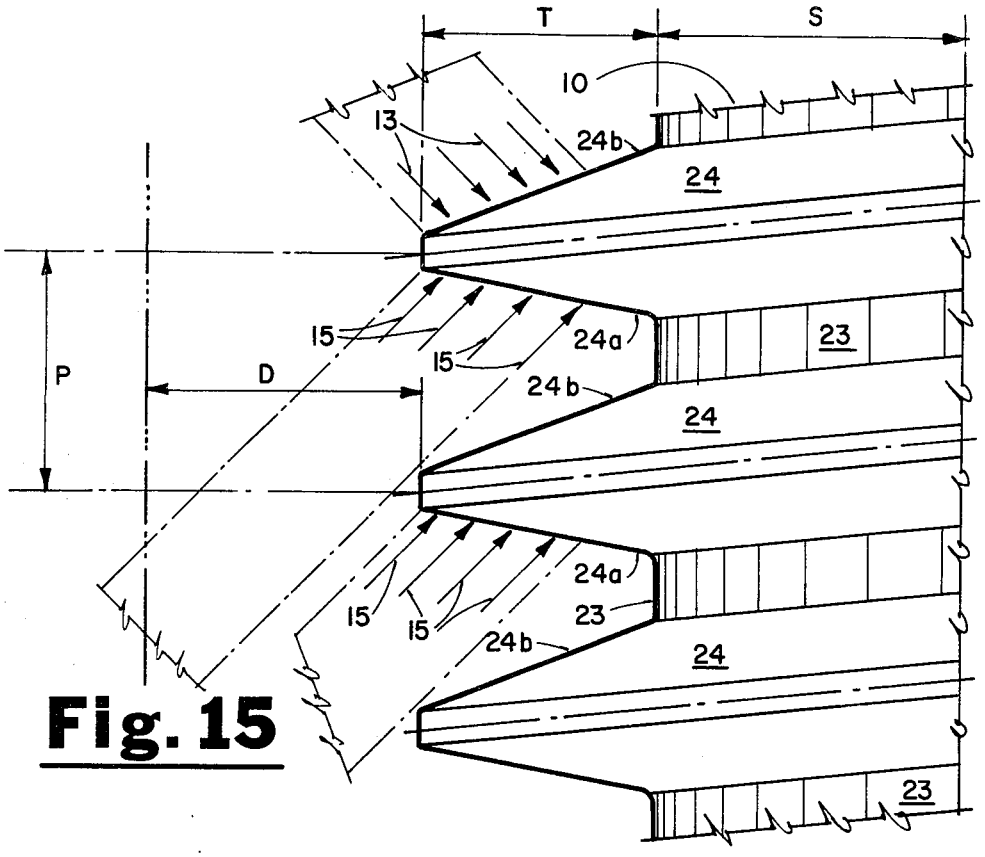
FIG. 15 is a partial schematic view of a plurality of threads on a portion of the preferred embodiment of the apparatus of the present invention.
Figure 14:
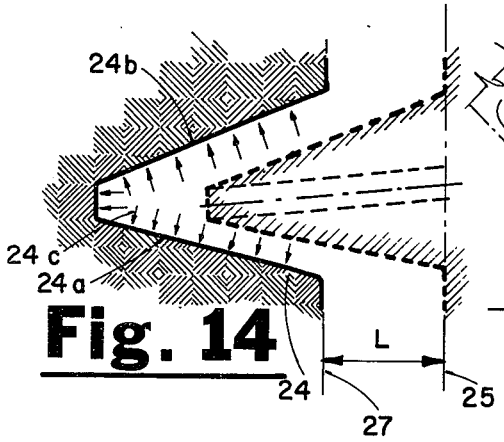
FIG. 14 is a partial schematic view of a thread portion of the preferred embodiment of the apparatus of the present invention illustrating the compressive lateral movement of a single thread against the "soil-socket" during insertion of the pile.
Figure 13:
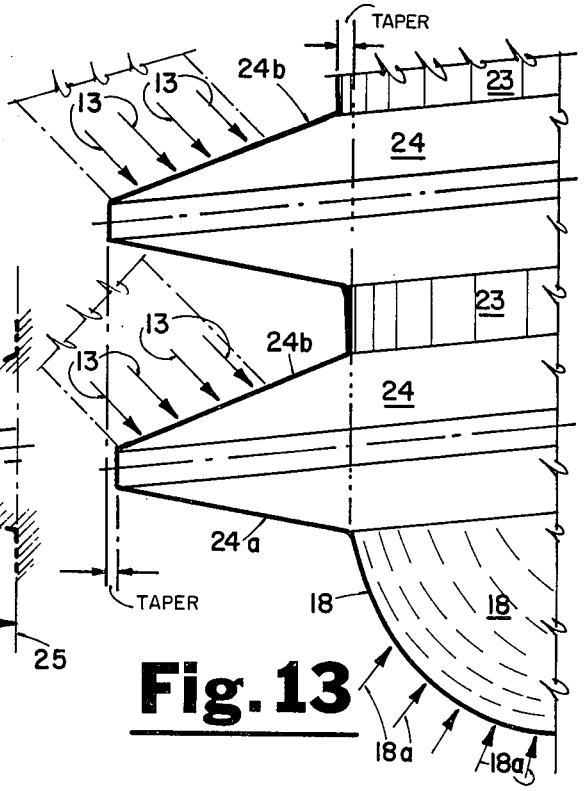
FIG. 13 is a partial schematic view of the lowermost tip portion of the preferred embodiment of the apparatus of the present invention illustrating the force experienced by the tip during insertion of the pile.

FIGS. 13–15 illustrates schematically the operation of the pile 10 of the present invention.

In FIG. 13, there is a schematic illustration of the tip portion 18 of pile 10 showing forces acting upon the tip 18 and the proximatel threads 24 while the pile is being driven into the earth. Note force arrows 18*a*, which indicate upward pressure bearing on the tip 18 as it is descending into the soil. During this insertion, the upper surface of each thread 24 will be pushing upwardly on the soil which contacts it on the upper surface. Note force arrows 13 which schematically illustrate this downwardly directed force of soil against thread 24. Thus, when the pile 10 is going down into the soil, there is an upward and generally outward force on the soil by the upper edge of the nearly flat projecting thread face 24*b*.

FIG. 15 further illustrates this force which is downwardly bearing on the upper face 24*b* of thread 24. Note in FIG. 15, a plurality of force arrows 15. These force arrows 15 are generally inward and upwardly bearing against the bottom face 24*a* of each thread 24. These force arrows illustrate the bearing of proximately located soil against the lowermost face 24*a* of each thread when the pile is taking the required dead and live loads of the building or like structure which may be erected at the surface of the soil which structure is being supported by pile 10, at least in part. When the pile 10 is taking this required dead and live load, the load on the soil is downward and thrusting out, with the load being transmitted through the lower face 24*a* of thread 24. Force arrows 15 indicate the force which opposes and supports pile 10 by the soil which bears against this face 24*a* thus supporting the pile.

As can be seen and as has been more fully discussed above, the thread vertical spacing in constant. This vertical spacing is illustrated by the arrow indicated by P in FIG. 15. Thread spacing P is constant, so that there will be no disturbance of the female thread socket which is created by the threads 24 as the pile is inserted into the soil by rotational force. Thus, each point on the outer periphery of the thread will pass through the same path and contact substantially the same soil as the thread before it. This mechanical action is highly desirable, and compacts the soil adjacent the pile as it is threaded into the soil. It should be appreciated, that the pile has a taper, and each successive thread pushes the soil further from the pile, as the pile is driven down, since the "thickening" pile as a whole occupies more and more space at any given depth as the pile is driven further down. This thickening of the pile is seen in FIG. 14, where a single thread 24 is seen moving from a first position 25 to a second position 27. In FIG. 14, the distance of lateral movement outwardly of the thread and thus the lateral pushing of the soil is indicated by the letter L. The substantially vertical lines 25, 27 are adjacent the base of thread 24 which it moves from a first position 25 to a second position 27. The force arrows 24*c* illustrate the bearing force of the thread 24 against the soil, which force gradually outwardly compacts the soil adjacent the thread.

This overall operation of outward movement of the thread can be, for example, on the order of about one and one half inches. This outward movement would be of course the difference in diameter of the pile measured from the center of the pile to the tip of the thread at any given point as contrasted with the diameter of the pile measured from the center of the tip of the thread member 24 adjacent tip 18. In a ten foot pile, it will be appreciated that the outward movement of the thread of one and one half inches takes place in the ten feet of pile penetration, or in about eighty feet of overall thread passage. Thus, a gradual thickening and compacting of the adjacent soil is seen by the tapered pile of the present invention as it is gradually inserted into the soil. An improved soil condition is seen adjacent the pile once it is in place. The screw-threaded pile 10 has gradually compacted the soil adjacent the pile as it is being threadably driven into the soil. The volume of soil compacted and displaced will be equal to that of the pile itself. An increased effective pile diameter is seen is as a result of this mechanical action. In FIG. 15, arrow D illustrates the increased effective diameter of pile 10. The radius of the piling 10 shaft 23 is indicated by arrow S. The thread projection is indicated by arrow T in FIG. 15.

Pile 10 can be constructed of any suitable structural concrete, such as four thousand pound per square inch reinforced concrete. Preferably, pea gravel would be used as a suitable aggregate, because of the smallness of threads 24 in some residential class piling. The reinforcing steel could be any suitable structural reinforcing bar such as a A36 steel.

As can be readily understood from the above description and from the drawings, a pile according to the invention provides a simple and efficient, yet rugged and reliable, manner of providing a suitable anchor or piling where needed remote from a manufacturing facility, and even in crowded conditions where heavy machinery cannot be taken.

In the method of driving pile of the present invention, it is important to utilize a pile of constant thread pitch. This will prevent cross-threading which destroys the desirable interface created between the pile and the surrounding soil. Preliminary tests have indicated that an area spread of at least one and one half times the original area of the threaded pile diameter is achieved when the pile structure 10 of the present invention is properly installed. It is desirable to provide a pile having a pitch of about six or more threads per foot. This desireable pitch of threads per foot is necessary in order that compatibility with differing soils be achieved. It is desirable that the piling be threadably inserted into the soil so that the soil is merely displaced and compacted forming a "soil-socket" which forms a female thread in fact for the pile itself as it is inserted. The tip of the pile can be provided with driving and cutting force if necessary. In fact, a jetting type arrangement can be provided at the tip in order to facilitate driving. Further, there can be provided the addition of water or other suitable lubricant to the pile's surface as it is inserted into the ground. Such a lubricant can be added to the soil socket into which the pile is threadably rotated, which socket is in fact created as the pile is driven. By pouring water on the threads of the pile as it enters the ground, a lubrication of the pile will be seen which will lessen the friction of the thread surfaces 24*a*, 24*b* with the surrounding soil.

When using a jointed pile, only the first section need be tapered, since the thread socket will have been properly formed once the largest thread diameter of the uppermost end of pile section 12 (see FIG. 1) passes into the soil. Thereafter, as many sectional constant diameter piles 10 as is desirable can be added to the original pile or piles as is desired. Each additional pile section 10 would of course be provided with feathering at the junction which will connect with the previous installed pile. Thus, once the pile connection is perfected as is illustrated by FIGS. 2 and 5 for example, a constant pitch smooth thread will be seen.

The means for applying torsion of the pile at its uppermost point can be any suitable torsional force. Thus, for example, a leverage bar can be inserted into opening 126 and the lever pushed on by a suitable force. In such a case, the pile could be hand-installed by manual labor. A low horsepower motor supplied with proper gearing could be utilized to provide such a torsional force. Additionally, a rope could be wrapped around the upper surface of the pile and pulled on to apply the necessary force in instances where a great deal of force was not required.

A pile according to the invention can be manufactured in any size or length, although piling in a length of 10 feet to 12 feet has been found suitable. The use of the tapered body of the pile and the provision of screw-threads along the entire length of the body provides a pile which has a friction capability of a conventional wood pile twice the length of the pile according to the present invention. Further, a pile according to the invention can be screwed into earth without a pilot hole under certain soil conditions, with only a steel leverage bar and capable personnel.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A precast, threaded, concrete pile, comprising:

(a) a metallic upper portion providing connection means for the application of rotational driving force thereto for driving the pile down into the ground by rotating it;

(b) a metallic reinforcement core integrally connected to said upper portion extending at least substantially down the full length of the pile; and (c) a generally circular shaped longitudinally extended, cementitious body precast about and embedding said core, said body having an outer surface provided with only a single continuous set of substantially equally spaced spiral screw threads along at least substantially the entire length thereof; whereby, in being rotatably driven at the head, the reinforcing core of the pile rather than the concrete directly carries the torsional and tensile forces created in the pile during its insertion.

2. The concrete pile of claim 1, wherein said threads have a relatively minor thread pitch providing a projecting surface of a relatively slight angle with the vertical for engaging and bearing against the soil into which the pile is inserted, the relatively minor thread pitch being mechanically compatible with the soil into which the pile is inserted, a reduced torsional stress being experienced by the pile.

3. The concrete pile of claim 2, wherein there is provided about six (6) or more of said threads per foot of pile length.

4. The concrete pile of claim 1, wherein said core is comprised of:

i. a plurality of longitudinally extending, high strength reinforcing bars, each integrally connected to said upper portion and extending down substantially the full length of said body;

ii. a plurality of longitudinally spaced reinforcing collars, each of said collars being integrally connected to said longitudinally extending reinforcing bars; and iii. at least one spiral reinforcing element, said spiral reinforcing element having a pitch at least generally similar to the pitch of said screw threads.

5. The concrete pile of claim 4, wherein said collars decrease in diameter from the top to the tip of the pile.

6. The concrete pile of claim 1, wherein said core is comprised of a longitudinally extended bar extending down the center-line of the pile substantially the full length of said body and a plurality of longitudinally spaced, laterally extending arms attached to said bar.

7. The concrete pile of claim 1, wherein said upper portion forms a head having at least four, equal, vertical sides for receiving driving socket tools to impart a rotational torque to the head.

8. The concrete pile of claim 7, wherein the head is constructed as a piece of solid material.

9. The concrete pile of claim 7, wherein the head is constructed as a metal sleeve connected to the core.

10. The concrete pile of claim 7, wherein the head is constructed as a framework connected to the core and embedded in a solid mass.

11. The concrete pile of claim 1, wherein said upper portion is provided with transverse through-hole means arranged for receiving a leverage bar to impart rotational torque to the head.

12. An extendible, reinforced, precast concrete pile system comprising:

(a) at least two, spiral threaded, precast pile sections placeable and connectable in line together, each of said pile sections being threaded along at least substantially its entire length with only a single, continuous set of threads of at least substantially the same pitch as that of the adjacent section;

(b) a reinforcement core provided in each pile section, each of said cores comprising at least one longitudinally extending reinforcement bar and at least one laterally extending member, each of said members being integrally connected to said longitudinal bar; and (c) connector means associated with said pair of pile sections for attaching said pile sections together for concurrent rotation with one another.

13. The system of claim 12, wherein said threads have a relatively minor thread pitch providing a projecting surface of a relatively slight angle with the vertical for engaging and bearing against the soil into which said pile is inserted, the relatively minor thread pitch being mechanically compatible with the soil into which the pile is inserted.

14. The system of claim 13, wherein there is provided about six (6) or more of said threads per foot of pile length.

15. The system of claim 12, wherein said connector means are metallic, and said bar and said connector means are integrally attached together within each of the pile sections.

16. The system of claim 12, wherein said connector means comprises a socket on one of said pile sections and a corresponding interlocking projection on the other of said pile section, said socket and said projection each being provided with a proximate metallic reinforcing member, said reinforcing member being connected to said core.

17. The system of claim 16, wherein said connector means is comprised of a socket on each of said pile sections and an interlocking structural key, said key having projections for attaching said key to each of said sockets to form a connection, and each of said sockets is provided with a proximate metallic reinforcing member, said reinforcing member being connected to said core.

18. The system of claim 12 wherein the end portion of each section adjacent said connector means is provided with feathered threads, with the connection of said sections providing a uniform, equally spaced, continuous thread pitch throughout the area adjacent said connector means.

19. The system as defined in claim 17, wherein the key is a length of rod provided with a plurality of splines.

20. A system as defined in claim 12, wherein said connector means includes a plurality of opposed sockets provided in each of the sections and arranged for receiving a like number of keys associated with the sockets.

21. A method for installing a concrete pile into a soil medium comprising the steps of:

a. providing a first reinforced concrete pile member, said pile comprising: i. a metallic reinforcement core; ii. an upper metallic driving attachment connected to said core; and iii. a tapered concrete substantially conical mass cast symmetrically about said core for rotation therewith; the tapered concrete mass being provided with an equally spaced spiral thread structure from substantially top to tip; b. orienting the pile member in a substantially erect position; and c. applying rotational force to said driving attachment without direct driving engagement with said concrete mass to rotationally drive the pile member into the ground.

22. The method of claim 21, wherein there is provided the further step of applying a lubricating agent to at least a part of the pile member.

23. The method of claim 21, wherein there is provided the further step of applying water to at least a part of the pile member.

24. The method of claim 21, wherein there is provided the further step "d" of forming with the pile member a compacted female thread soil socket in the soil medium; the soil socket having a thread pitch equal to the thread pitch of the pile member.

25. The method of claim 24, wherein in step "d", each thread member laterally displaces a portion of the adjacent soil medium away from the pile member as the pile is rotated by the applied rotational force.

26. The method of claim 21, further comprising the step of rotating the pile member until its insertion into the soil medium places the pile member's uppermost portion at the soil surface.

27. The method of claim 26, comprising the further steps of providing a second pile member of substantially constant diameter; structurally connecting the first and second pile members; and applying rotational force to the second pile member.

28. A method for installing a concrete pile into a soil medium comprising the steps of:

a. providing a first reinforced concrete pile member, said first pile member comprising:
   i. a metallic reinforcement core;
   ii. an upper metallic driving attachment connected to the core; and
   iii. a tapered concrete substantially conical mass cast symmetrically about said core for rotation therewith, the tapered concrete mass being provided with an equally spaced thread structure from substantially top to tip.
b. providing a second reinforced concrete pile member, said second pile member comprising:
   i. a metallic reinforcement core; and
   ii. a concrete mass cast about said core for rotation therewith,
c. providing a connection means on each of the pile members for structurally joining the first and second members together;
d. orienting the first pile member in an erect position;
e. applying rotational force to the first pile member until its upper portion is adjacent the surface of the soil medium;
f. connecting the first and second pile members together; and
g. applying rotational force to the second pile member.

29. The method of claim 27, wherein there is further provided the step of forming with the first pile member a compacted female thread soil-socket in the soil medium, the soil socket having a thread pitch equal to the thread pitch of the pile member.

30. The method of claim 28 wherein there is provided the further step of adding additional constant diameter pile sections to the previous uppermost pile section as the upper surface of the previous uppermost pile section nears the surface of the soil medium.

31. The concrete pile of claim 1 wherein said body is tapered down from a maximum diameter at the top to a minimum diameter at its bottom, forming a generally conical shape.

32. The concrete pile of claim 1, wherein said body is at least generally cylindrically shaped, having at least generally a constant diameter along its length.

* * * * *